United States Patent [19]

Ohta

[11] 4,229,009

[45] * Oct. 21, 1980

[54] LIGHT-EMISSION GUN AMUSEMENT MACHINE FOR HOME USE

[75] Inventor: Takao Ohta, Hirakata, Japan

[73] Assignee: Nintendo Co., Ltd., Kyoto, Japan

[ * ] Notice: The portion of the term of this patent subsequent to Oct. 4, 1994, has been disclaimed.

[21] Appl. No.: 906,277

[22] Filed: May 15, 1978

Related U.S. Application Data

[63] Continuation-in-part of Ser. No. 893,302, Apr. 4, 1978, abandoned.

[30] Foreign Application Priority Data

Apr. 5, 1977 [GB] United Kingdom ..... 14414/77
May 13, 1977 [JP] Japan ..... 52-55803

[51] Int. Cl.[3] ..... F41J 5/02; F41J 9/14
[52] U.S. Cl. ..... 273/312; 273/358
[58] Field of Search ..... 273/101.1, 310, 311, 273/312, 358; 35/25

[56] References Cited

U.S. PATENT DOCUMENTS

| | | | |
|---|---|---|---|
| 2,442,240 | 5/1940 | Hooker et al. | 273/101.1 |
| 2,456,826 | 12/1948 | Hawe | 273/101.1 |
| 3,147,664 | 9/1964 | Gelfand | 273/101.1 X |
| 3,904,204 | 9/1975 | Yokoi | 273/101.1 |
| 3,918,714 | 11/1975 | Ceccaroni | 273/101.1 |
| 3,955,292 | 5/1976 | Robertsson | 35/25 |
| 3,990,704 | 11/1976 | Meyer et al. | 273/101.2 |
| 4,052,066 | 10/1977 | Ohta | 273/101.1 |

FOREIGN PATENT DOCUMENTS

| | | | |
|---|---|---|---|
| 2813821 | 10/1977 | Fed. Rep. of Germany | 35/25 |
| 513825 | 12/1937 | United Kingdom | 273/101.1 |

*Primary Examiner*—Anton O. Oechsle
*Attorney, Agent, or Firm*—Wenderoth, Lind & Ponack

[57] ABSTRACT

A light-emission gun amusement machine for projecting a light image onto a screen and for receiving a reflected image from said screen. The device uses a light-emission gun, and has a machine housing separate from the light-emission gun and the screen. Within the housing are: a light source, a photoelectric element above the light source; and a lens system between the light source and the photoelectric element within the housing and the screen outside the housing for coaxially aligning the light rays from the light source to the screen and the light rays from the screen returning toward the photoelectric element. Furthermore, there is an electrically operative motor within the housing with a main shaft operatively connected thereto, and an electric power source connected to the light source and the motor. A power source control means actuated by the photoelectric element reverses the electrical connection between the power source and the motor when light is reflected from the screen onto the photoelectric element, thereby reversing the normal rotational direction of the motor. Finally a target producing means is contained within the housing between the light source and the photoelectric element and is operatively connected to the main shaft for producing target and hit images of the light source on the screen.

11 Claims, 15 Drawing Figures

LIGHT-EMISSION GUN AMUSEMENT MACHINE FOR HOME USE

This application is a continuation-in-part application of U.S. patent application Ser. No. 893,302, filed Apr. 4, 1978, now abandoned.

BACKGROUND OF THE INVENTION

The present invention relates to an amusement machine of a type wherein a moving luminous mark projected on a screen is shot by a marksmen with a gun which emits a light beam.

In systems of this general type, there are elaborate arrangements wherein a successful shot with a light beam gun at a mark on a screen is indicated by the cancellation of the mark and the projection of a falling mark on the screen. Also, there are systems which incorporate thereinto electronically controlled visual and audio indicators for indicating the hit. However, the electronic circuity which is necessarily required for these systems demands a high degree of complexity, especially when the system is provided with both a target mark projection unit and a separate hit mark projection unit, thereby making the apparatus both too costly and bulky for general entertainment use.

The applicant has overcome many of these problems in his prior U.S. Patent, U.S. Pat. No. 4,052,066 which provides for a home entertainment device of this type with a greatly simplified target projecting means and hit indication means. In that patent, the flight of the target object is indicated by a constant change in the area and configuration of the target through changing the block area of the mark aperture by means of movable shutter members. When the mark is sucessfully hit, the movement of the shutters is ceased and a fixed configuration shines on the screen. As a result, in that invention the flapping of the bird's wings ceases, thus indicating that the target object has been hit. One problem with that invention, however, is the fact that there is no way of indicating that the target has been hit other than by stopping the movement of the entire configuration.

Another problem with the prior art invention is that in these inventions the target rays projected onto the screen are emitted from a light source and are condensed by a condensing lens system or a condensing mirror system. The rays then pass through a silhouette plate or diaphragm, a condensing or projecting lens, and are finally reflected by a mirror to project the luminous target mark onto a screen. The hit rays from the light-emission gun reflect from the screen and are reflected by the mirror and focused onto a photoelectric element by a focusing lens.

In the above described prior art amusement machines, the condensing or projecting lens for the target rays is separate and independent of the focusing lens for the hit ray. When the distance from the lens to the screen is short, the target rays are not parallel to the hit rays at the same point on the screen. That is, the optical axis of the target rays emitted from the light source to the condensing lens is not parallel to the optical axis of the hit rays from the focus lens to the photoelectric element. Therefore, both the projecting lenses and the focusing lenses must be mounted in the housing so that the optical axis of the target rays and hit rays are at a specifically defined angle. Such a construction is very complicated.

As an example of the difficulity with this dual lens system, suppose a screen and unit are arranged at a specified distance from each other. The unit is made up of a light source, the photoelectric element and the lenses and has a means for emitting target rays and detecting hit rays which reflect from the screen. The angle between the optical axis of the target rays and the optical axis of the hit rays is set so as to correspond to the given distance conditions. When the unit is subsequently moved or the distance between the screen and the unit varied, or if the unit is inclined in a vertical or horizontal direction, or if the angle of inclination of the mirror within the unit is changed, a slip occurs between the center point of the range of the hit rays on the screen and the center point of the luminous mark on the screen. Accordingly, when the target mark on the screen is hit by the hit rays, because of the change in position of the unit, the quantity of light incident upon the focusing lens and the photoelectric element at the time of hitting will vary from the original amount which was designed for the first specified conditions. Thus, the sensitivity of the photoelectric elements varies and the hitting rate will vary with the location of the mark on the screen in these units which have separate and distinct projecting and focusing lens system.

SUMMARY OF THE INVENTION

It is, therefore, an object of the present invention to provide an improved amusement machine of the kind described which can simulate a change of the real target object at a successful hit by changing the direction of the target on the screen as well as the configuration of the target object. Furthermore, in view of the defects which are attributable to the parallel arrangement of the light source for the mark and the photoelectrical element, it is an object of the present invention to make the optical axis of the target rays substantially coincident with the optical axis of the hit rays, thereby making the relative distance between the center point of the mark on the screen and the center point of the hit rays on the screen constant, and preferable to make both center points coincide exactly.

According to the present invention, there is provided a light-emission gun amusement machine including a light-emission gun, a photoelectric element, a light source, a screen, a mirror interposed between the light source and the screen to reflect the light beam from the light source onto the screen and thereby produce a target mark thereon, a mirror vertical drive mechanism connected to the main shaft driven by an electric motor in such a manner that the motor tilts back and forth throughout the rotation of the electric motor, a mirror horizontal drive mechanism disconnectably associated with the main shaft via a one-way clutch operable only in a normal direction of rotation of the motor, whereby the mirror is driven horizontally only during the rotation in the normal direction of rotation of the electric motor, and a power supply device for reversing the electrical connection between the motor and a power supply upon generation of an output signal from the photoelectric element actuated by the light-emission gun to reverse the rotational direction of the electric motor, whereby the target mark is caused to move diagonally in a composite direction made up of horizontal and vertical component directions on the screen during a normal rotation of the motor to simulate a flight of a target, and the mark is then caused to move only vertically downwardly upon suspension of the horizontal drive of the motor as the motor is driven in reverse in response to the generation of the output signal and thereby simulates the falling of the target. Further provided in the present invention is a lens system between the photoelectric element and the screen, the photoelectric element being on or near the optical axis between the light source and the lens system. The lens system therefore makes the optical axis of the target rays coincide almost exactly with the optical axis of the hit rays reflected from the screen.

To provide the full feeling of the hit corresponding to a changing configuration of the target mark during the vertical movement of the mark downward on the screen, the present invention provides a first movable diaphragm member with both a hit mark aperture and a target aperture therein. The first diaphragm is moved by rotating the main shaft in a reverse direction to such a position that the hit mark aperture blocks light between the light source and the mirror. A second movable diaphragm plate is provided adjacent the first movable diaphragm plate and has at least two shutter holes therethrough, each different in area size. When the main shaft moves in the normal direction, the shutter holes change the effective area of the target mark aperture of the first diaphragm member, and thereby change the configuration of the target mark on the screen to produce a moving sensation. When the main shaft turns in the reverse direction, the second movable diaphragm shifts to a position where it does not cover the target mark aperture of the first movable diaphragm so that the area and configuration of the target ceases to change and the hit mark aperture is exposed between the light source and the mirror. Also, when the main shaft turns in the reverse direction, the hit mark projected onto the screen is moved only downward in the vertical direction. In this manner, the flight of the target can be simulated across the screen, and when the target mark is hit, the main shaft reverses to indicate a hit configuration which then falls downward.

Furthermore, because of the construction of the single lens through which the target rays and the hit rays project, the hit ray will effectively reflect directly onto the photoelectric element every time, without having to individually adjust both a projecting system for the target rays onto the screen and a focusing system for the hit rays onto the photoelectric element.

BRIEF DESCRIPTION OF THE DRAWINGS

Further objects and a more thorough understanding of the present invention will be apparent from the accompanying drawings, wherein:

FIG. 12A, 12B and 12C show respectively a partial plan view of a device for changing the configuration of the target mark in response to the pivotal movement of a second diaphragm member, in which FIG. 12A shows the case where the second diaphragm member is positioned to the right, FIG. 12B shows the case where the second diaphragm member is in an intermediate position, and FIG. 12C shows the case where the second diaphragm member is positioned to the left.

DETAILED DESCRIPTION OF THE INVENTION

Figure 1:
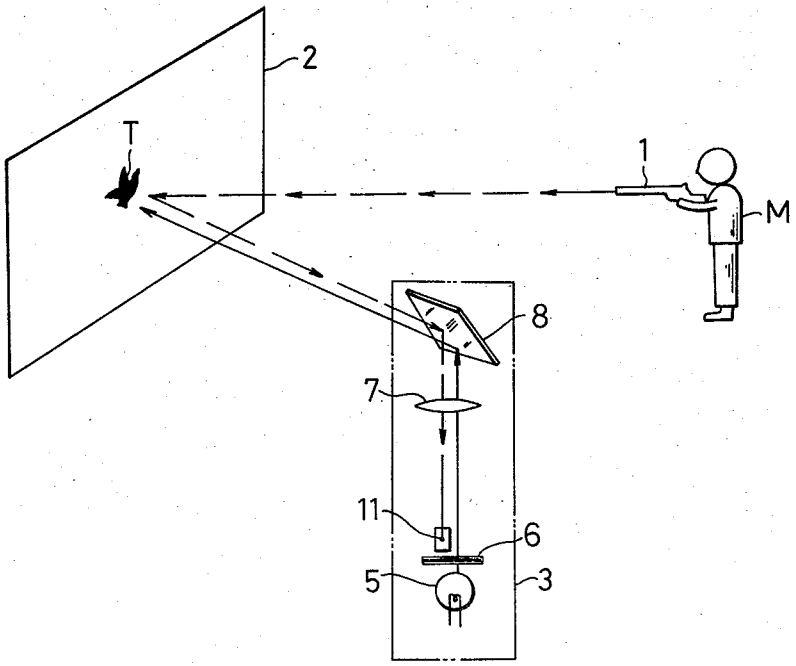
FIG. 1 is a schematic diagram showing an embodiment of the light-emission gun amusement machine according to the present invention.
Figure 2:
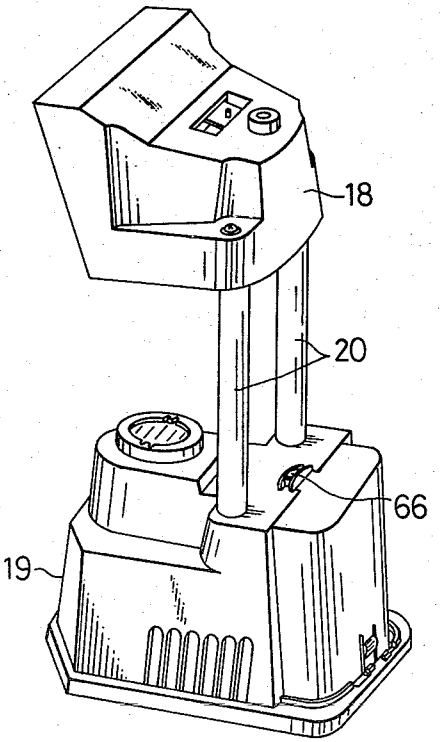
FIG. 2 is a perspective view showing a target mark-generating and hit-indicating unit of the machine.

Referring to FIG. 1 a light-emission gun amusement apparatus is shown which comprises a light-emission gun 1 held by a marksman M, a screen 2 adapted for mounting on the wall of a room, and a target mark forming a hit-display unit 3. The hit-display unit 3 is built into a housing as shown in FIGS. 2 to 6, and comprises a power supply 4, a light source 5, a diaphragm unit 6, a lens system 7, a mirror 8, a mirror drive unit 9, a motor control drive 10 and a photoelectric element 11 which generates an output signal upon incidence of light. The photoelectric element may be a solar cell or a phototransistor element, for example. Thus, the light beam from light source 5 passes through diaphragm unit 6 and lens 7, is reflected by mirror 8 and forms a luminous mark T on the screen 2. If the marksman hits the target mark, the light from the light-emission gun 1 is reflected by the screen 2 and this reflected light is again reflected by the mirror 8. The light thus reflected by the mirror 8 passes through the lens 7 which focuses the light on the photoelectric element 11.

The response of the photoelectric element 11 to light actuates a motor control device 10 to change the direction of rotation of an electric motor 12. Referring to an incident light Q and a hit light P, these lights are condensed by using a single lens system. Since the photoelectric element 11 is located between the light source 5 and the lens system 7 and is nearer to the lens system than is the diaphragm unit 6, the diameter $D_1$ of the section of light flux at the point where it passes through the photoelectric element 11 is much larger than the diameter $D_2$ of the surface (the shading area) of the photoelectric element 11. Thus, the shading action of the incident light Q, whose light flux section is almost equal to that of the hit light P, is slight. The mirror drive unit 9 is designed such that the rotation of the electric motor 12 is transmitted through a speed-reducer 13 to a main shaft 14 which drives a mirror vertical drive mechanism 15 and, via a one-way clutch 16, a mirror horizontal drive mechanism 17, whereby the horizontal and vertical tilting angles of the mirror 8 are changed with respect to the incident light Q from the light source 5. This causes the target mark on the screen 2 to move diagonally across the screen as a composite of its horizontal and vertical movements, thus producing a simulated flying target.

The above-mentioned parts of the apparatus are built in an upper case 18 and a lower case 19, as shown in FIGS. 2, 3, 4 and 5. These cases 18, 19 are connected together by means of a pair of props 20. A drive shaft 22 of the mirror vertical drive mechanism 15 in the upper case 18 is driven by the main shaft 14 via a transmission shaft 21 directly coupled thereto.

Figure 3:
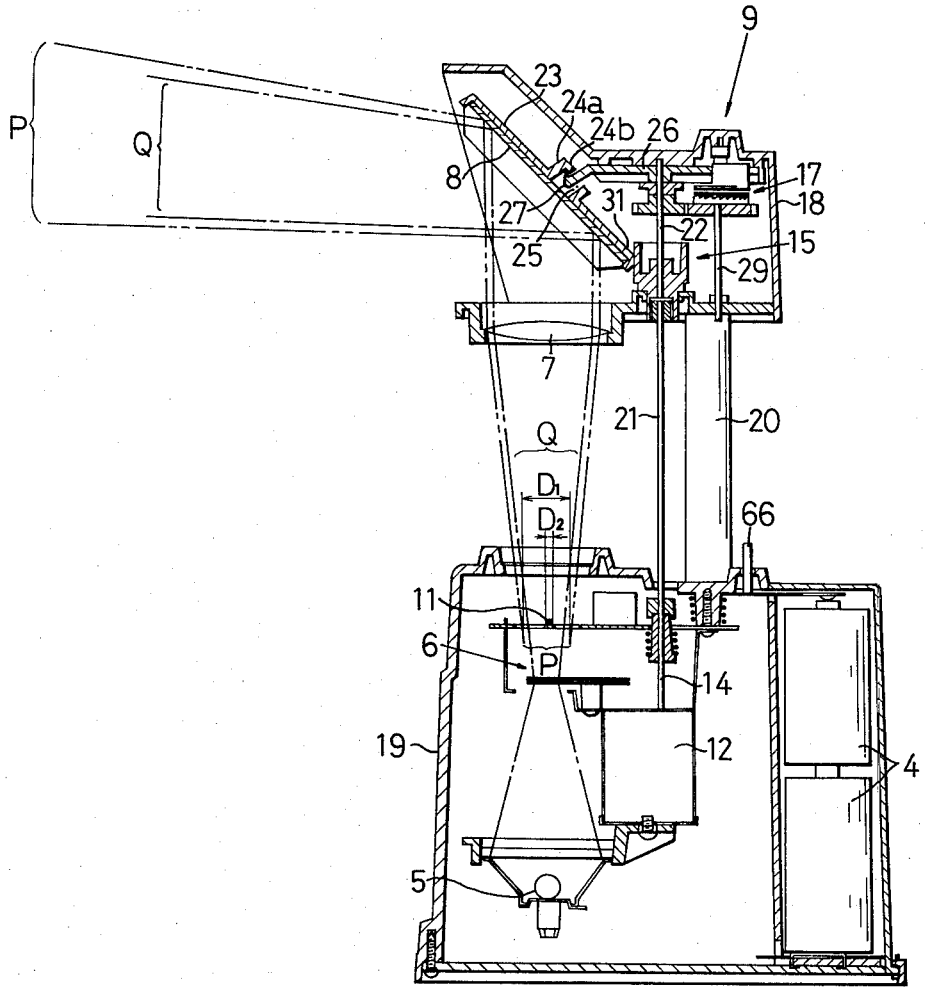
FIG. 3 is a vertical section of the unit shown in FIG. 2.
Figure 4:
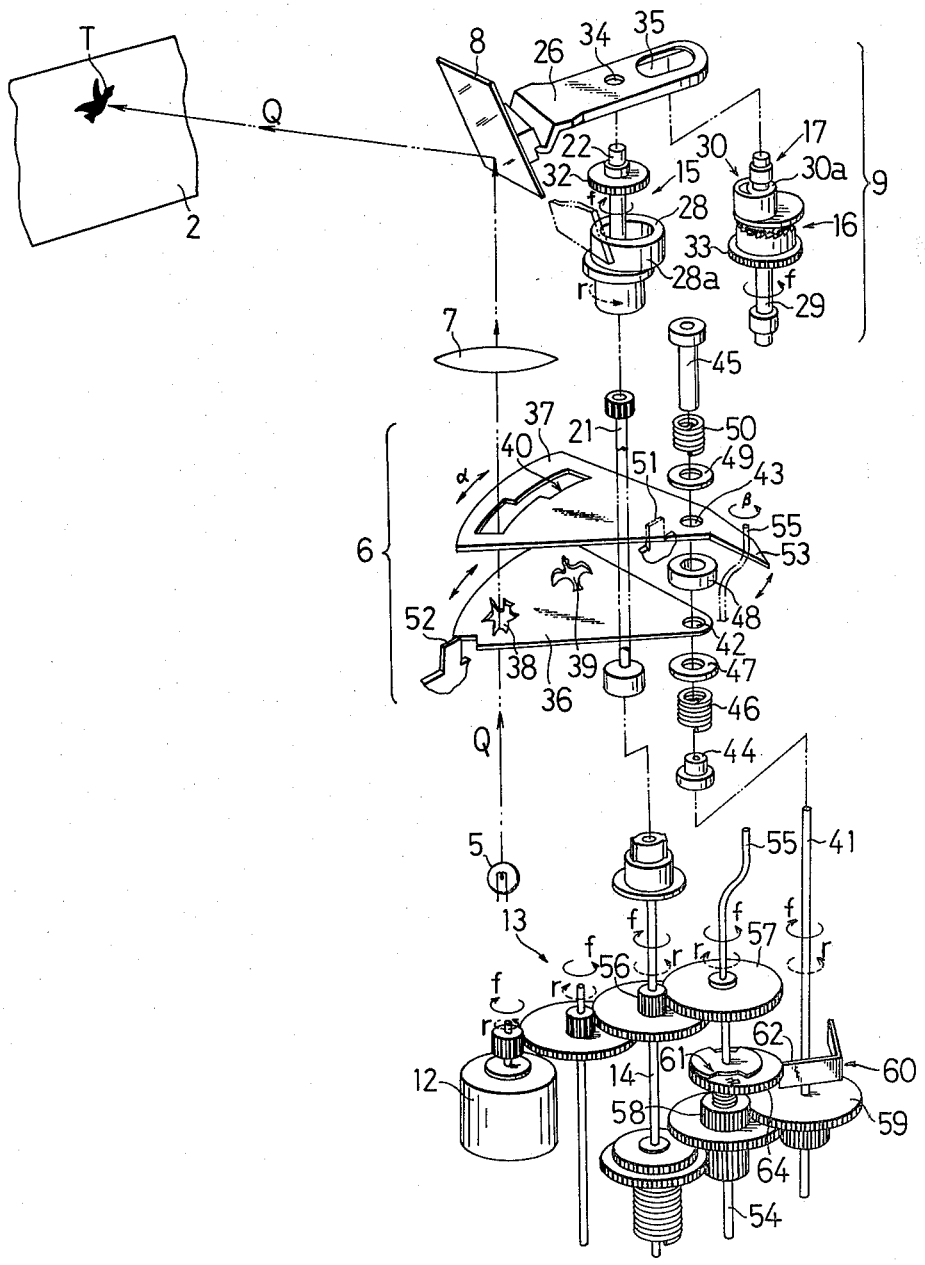
FIG. 4 is an exploded view of a driving mechanism of the unit shown in FIG. 2.
Figure 5:
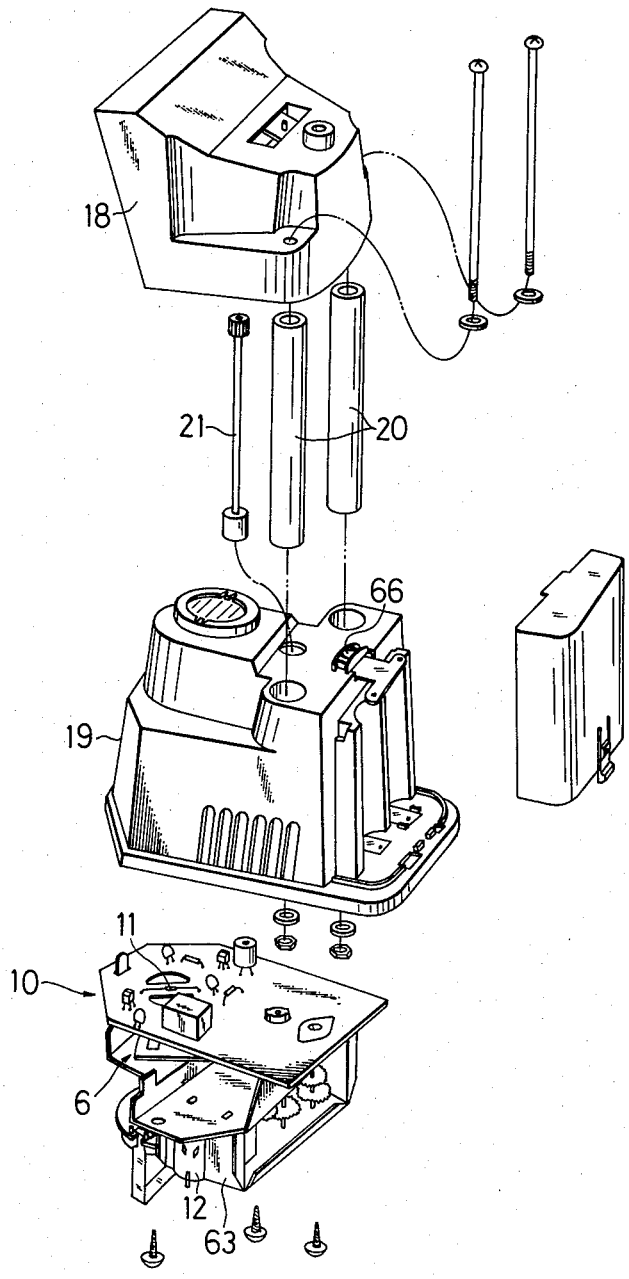
FIG. 5 is an exploded view of the unit shown in FIG. 2.
Figure 6:
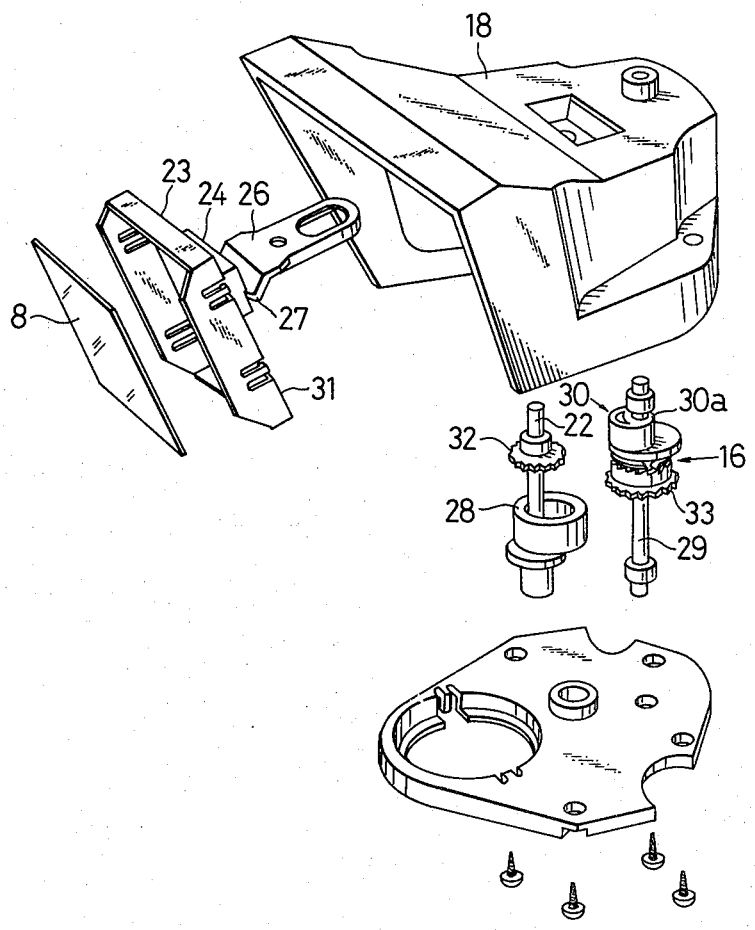
FIG. 6 is an exploded view of an upper case of the unit.
Figure 7:
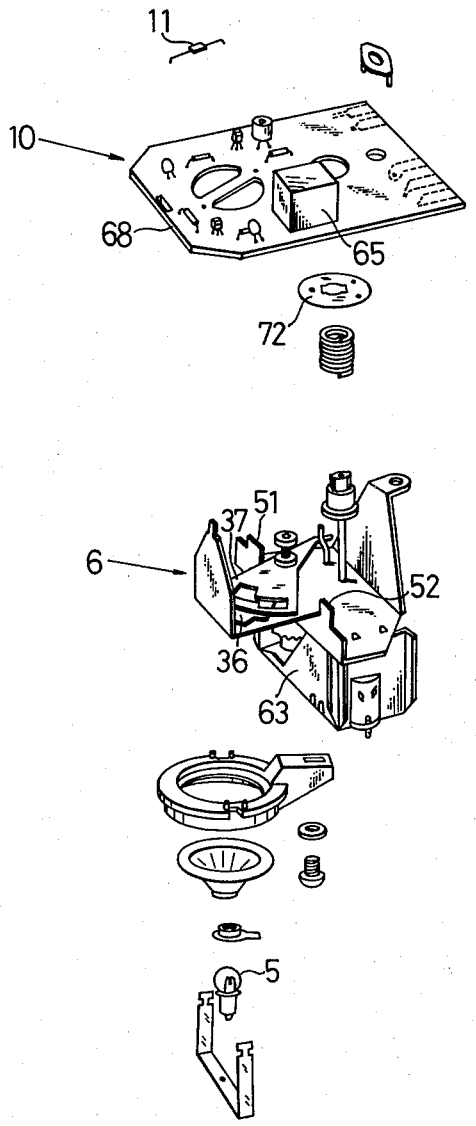
FIG. 7 is an exploded view of an internal mechanism of a lower case of the unit.

Referring to the mirror vertical drive mechanism 15 shown in FIGS. 3, 4 and 6, there is a support plate 23 carrying the mirror 8 at its front and having at its rear a box-shaped hanger 24 with a longitudinal opening through which a hook 27 of a support arm 26 is inserted. The hook extends and fits between two walls 24*a*, 24*b*, whereby the support arm 26 supports the mirror 8 in such a manner that the mirror 8 is allowed to tilt back and forth. On the other hand, both sides of the hook 27 of the support arm 26 make contact with side walls of the hanger 24, so that the support arm 26 and the support plate 23 are allowed to move as a body in horizontal directions. A cam face 28*a* of a first eccentric cam 28 fixed to the drive shaft 22 is kept in contact with a lower back part 31 of the support plate 23, whereby the part at which the lower back part 31 of the support plate 23 makes contact with the cam face 28*a* moves back and forth with the rotation of the first cam 28 by turning of the drive shaft 22. Accordingly, the angle of reflection of light Q from the mirror 8 is varied to cause the target mark T to move vertically across the screen 2.

Referring to the mirror horizontal drive mechanism 17 shown in FIGS. 3, 4 and 6, a driving shaft portion 30*a* in a second eccentric cam 30 is loosely mounted on a revolving shaft 29 installed to rotate in the upper case 18. The driving shaft portion 30*a* in the second eccentric cam 30 is driven by the revolving shaft 29 via a one-way clutch 16 operable only in a normal rotational direction. Both the drive shaft 22 and the revolving shaft 29 are linked via a gear 32 and a gear 33 so that the second eccentric cam 30 is driven only during rotation in the normal direction of the motor 12. The support arm 26 is made movable in the horizontal direction by passing the drive shaft 22 through a hole 34 at the intermediate part of the support arm 26. The aforementioned second eccentric cam 30 is inserted in an elliptical hole 35 at the end portion of an extension of the support arm 26 for interlocking, whereby in response to the revolution of the revolving shaft 29 via the second eccentric cam 30 and the support arm 26 associated therewith, the mirror 8 is swung in a horizontal plane to vary its angle of inclination with the perpendicular and, thereby, to cause the target mark T to move in a horizontal direction across the screen 2.

Referring to FIGS. 4, 5, 7, 11 and 12, the diaphragm unit 6 comprises a first movable diaphragm member 36 and a second movable diaphragm member 37. The first movable diaphragm member 36 has a target mark aperture or transparent configuration 38 and a hit mark aperture or transparent configuration 39. The second movable diaphragm member 37 has a shutter hole 40 comprising a first portion 40A, a second portion 40B, and a third portion 40C, whereby the light beam Q passing through the target mark aperture or transparent configuration 38 is intercepted partially and also the shaded area is changed by movement of the second diaphragm member 37 in the $\alpha$ direction (FIG. 4) and thus the configuration of the target mark T on the screen 2 is changed.

The above-mentioned first movable diaphragm member 36 and the second movable diaphragm member 37 are pivotally and coaxially supported by a revolving shaft 41 which passes through holes 42, 43. The first movable diaphragm member 36 is positioned below the second movable diaphragm member 37. A ring 44 and a tube 45 are secured to the revolving shaft 41, over which washers 47, 48, 49 and a compressible spring 50 are passed so as to press the first movable diaphragm member 36 and the second movable diaphragm member 37 from above and below, thereby urging both members 36, 37 to move in the direction in which the revolving shaft 41 turns. Stops 51, 52 are provided to limit the movable range of the first movable diaphragm member 36.

With the above arrangement, when the revolving shaft 41 turns in a normal direction the movable diaphragm member 36 hits against the stop 51 and rests there, whereupon the target mark aperture or transparent configuration 38 is positioned at a path of the light beam Q from the light source 5. On the other hand, when the revolving shaft 41 turns in the reverse direction the first movable diaphragm member 36 stops at the position where it makes contact with the stop 52, whereupon the hit mark aperture or transparent configuration 39 is positioned in the path of the light beam Q from the light source 5. A projection 53 is made at the pivotal part of the second movable diaphragm member 37 so that it makes contact with a crank portion 55 formed at the end of a revolving shaft 54. Thus, the second movable diaphragm member 37 makes reciprocal motion in the $\alpha$ direction with the rotary movement of the crank portion 55 in the $\beta$ direction (see FIG. 4) and thus the shutter hole 40 is caused to make a reciprocal motion in the $\alpha$ direction.

The aforementioned revolving shaft 54 is driven by the main shaft 14 at reduced speed via gears 56, 57 and drives the revolving shaft 41 at reduced speed via gears 58, 59. Furthermore, a sound-emission apparatus 60 adapted to produce a simulated cry of the prey or other sound effect upon successful shooting is connected to the lower end of the revolving shaft 54 via a one-way clutch 61 which is actuated when the revolving shaft 54 is driven in the reverse direction. The aforementioned sound-emission apparatus 60 is so designed that a vibrating member 62, one end of which is secured to a drive case 63 is positioned in engagement with a partially serrated plate 64 rigidly secured to the driven side of one-way clutch 61 so that as the one-way clutch 61 is actuated, the serrated plate 64 rotates to drive the vibrating member 62 which emits the sound effect as mentioned above.

Figure 8:
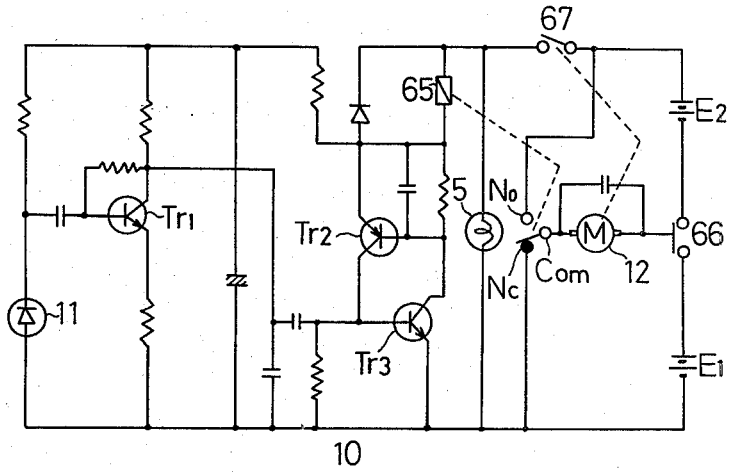
FIG. 8 is an electric circuit diagram of a motor control device.

Referring to the motor control device 10, it comprises a photoelectric element 11, transistors TR1, TR2, TR3 and a relay 65 which are connected as shown in FIG. 8. The operation of the relay 65 is controlled by output signals from the photoelectric element 11. Normally, common contact (Com) and normal contact (Nc) are connected and the motor 12 runs in a normal direction but when the relay 65 is actuated common contact (Com) and operation contact (No) are connected and the motor 12 runs in the reverse direction.

Figure 9:
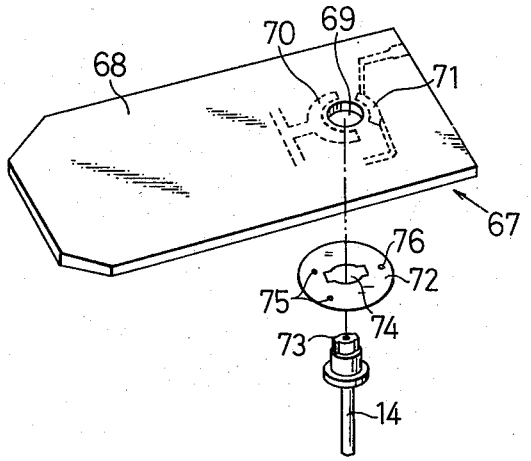
FIG. 9 is an exploded view of the lamp switch.

In FIG. 8, numeral 66 denotes a main switch and numeral 67 is a lamp switch. In the circuit shown in FIG. 8, each part is mounted on a printed wiring circuit board 68 fixed in the lower case 19, except for power supply 4. The power supply comprises a power source $E_1$ for providing power in the normal direction including the main switch 66, the motor 12 and two 1.5 V batteries and another power source $E_2$ for providing power in the reverse direction. The main switch 66 comprises a pair of contact plates 70, 71 (FIG. 9) printed at the rear or bottom side of the printed wiring circuit board 68 and adjacent a hole 69 made in the board 68. A rotary metallic disc 72 is fixed to the main shaft 14 which passes through the hole 69, there being a key 73 secured to the main shaft 14 which engages in a key way 74 of the rotary metallic disc 72. Protrusions 75, 75 made at the inner circumferential surface of the rotary metallic disc 72 and a protrusion 76 made at the outer circumferential surface of the disc 72 are adapted to make contact with the contact plate 70 and the contact plate 71 respectively. While the protrusion 76 is out of contact with the contact plate 71, the rotary metallic plate 72 does not electrically connect the contact plates 70 and 71 and therefore the lamp switch 67 is OPEN.

In starting the game, the main switch 66 is closed to turn on the light source 5, whereupon the mark is displayed on the screen 2 and, at the same time, the electric motor 12 is started and rotates in the normal direction as indicated by arrow mark (f) in FIG. 4. With the motor 12 thus started, the mirror horizontal drive mechanism 17, the mirror vertical drive mechanism 15 and the diaphragm unit 6 are also simultaneously driven so that the mark on the screen 2 is caused to move in a composite direction made up of X-axis and Y-axis components and, thereby, simulate a flight of a prey such as a bird. As will be described in detail below, the mark is varied in shape by the diaphragm mechanism.

The mirror vertical drive mechanism 15 causes the mark not only to ascend but also to descend and the path of flight of the mark includes the path component indicated by solid line ($Z_1$) and the path component indicated by broken line ($Z_2$). Referring to the light source, it is so designed that when the first eccentric cam 28 of the mirror vertical drive mechanism 15 is tilting the mirror 8 forward in order to lower the target mark T on the screen 2, light is cut out by the operation of the lamp switch 67. Therefore, of the flight path of the mark, the component indicated by broken line ($Z_2$) is not actually shown but the mark appears on the screen only during its ascending flight, thus making it difficult for the marksman to anticipate the starting point of the next flight.

Furthermore, upon the fall of the mark, which will be described hereinafter, the angular relation of the first eccentric cam 28 and the second eccentric cam 30 is altered so that the next ascending flight will start at the point where the mark falls, thus making the flight path more complicated. Therefore, flights will substantially never be repeated in the same path.

Upon a successful shooting by the marksman at the mark moving in the flight path $Z_1$, an output signal is generated by the photoelectric element 11 to drive the motor control device 10 which actuates the relay 65 to reverse the rotation of the motor 12. Upon reverse rotation of the motor 12, the main shaft 14, drive shaft 22 and the revolving shaft 29 are driven in the reverse as shown by arrow mark (r) in FIG. 4, the mirror horizontal drive mechanism 17 is arrested as the one-way clutch 16 suspends the transmission of motor output to the second eccentric cam 30, and the vertical drive mechanism 15 is reversed so as to cause the mark to descend vertically in the direction of the Y-axis only and, therefore, to simulate a fall of the prey down the screen 2.

By the reverse turning of the revolving shaft 54, the sound-emission apparatus 60 is actuated, whereupon the partially serrated plate 64 turns and makes the free-end of the vibrating member 62 vibrate to produce a simulated cry of a bird.

Figure 10:
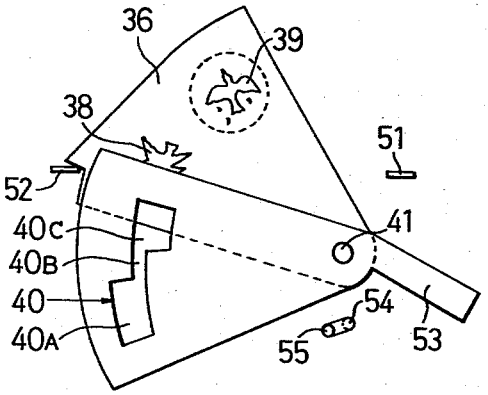
FIG. 10 is a plan view showing the diaphragm device employed in the light-emission gun amusement machine according to the present invention.

Furthermore, by the reverse turning of the main shaft 14, the revolving shaft 41 and the revolving shaft 54 are also reversed and as indicated by FIG. 10, while the first movable diaphragm member 36 moves so that the hit mark aperture or transparent configuration 39 is positioned at the path of the light beam Q; the second movable diaphragm member 37 moves to a position where it is not acted upon by the light beam Q. Thus, the target mark T on the screen 2 changes to the hit mark H to show a falling posture.

In the above way, upon successful shooting the target falls perpendicularly down in the falling posture and thus a change similar to a hit in actual shooting is projected on the screen 2.

An explanation is made below as to the change of shape of the target mark T in flight by the action of the second movable diaphragm member 37 of the diaphragm unit 6.

While the motor 12 is running in the normal direction, the light beam Q emitted from the light source 5 passes through the target mark aperture 38 of the first movable diaphragm member 36 and the shutter hole 40 of the second movable diaphragm member 37, whereby the target mark T is formed on the screen 2.

Figure 11:
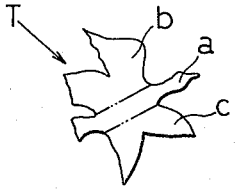
FIG. 11 is a schematic view showing the configuration of the target mark.
Figure 12A:
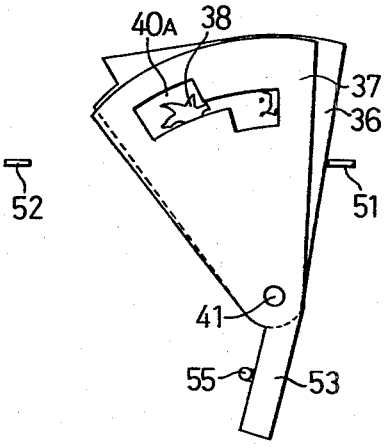
Figure 12B:
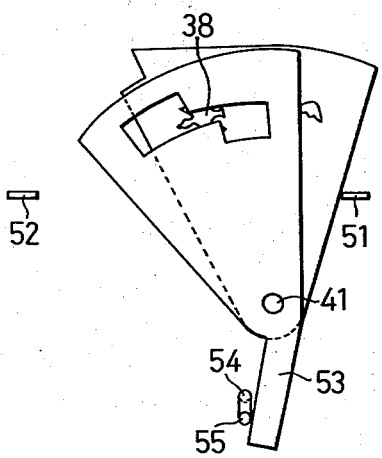
Figure 12C:
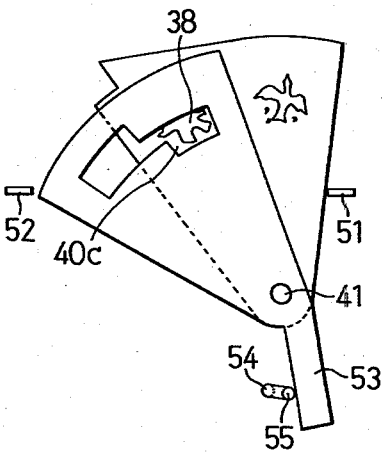
Figure 13:
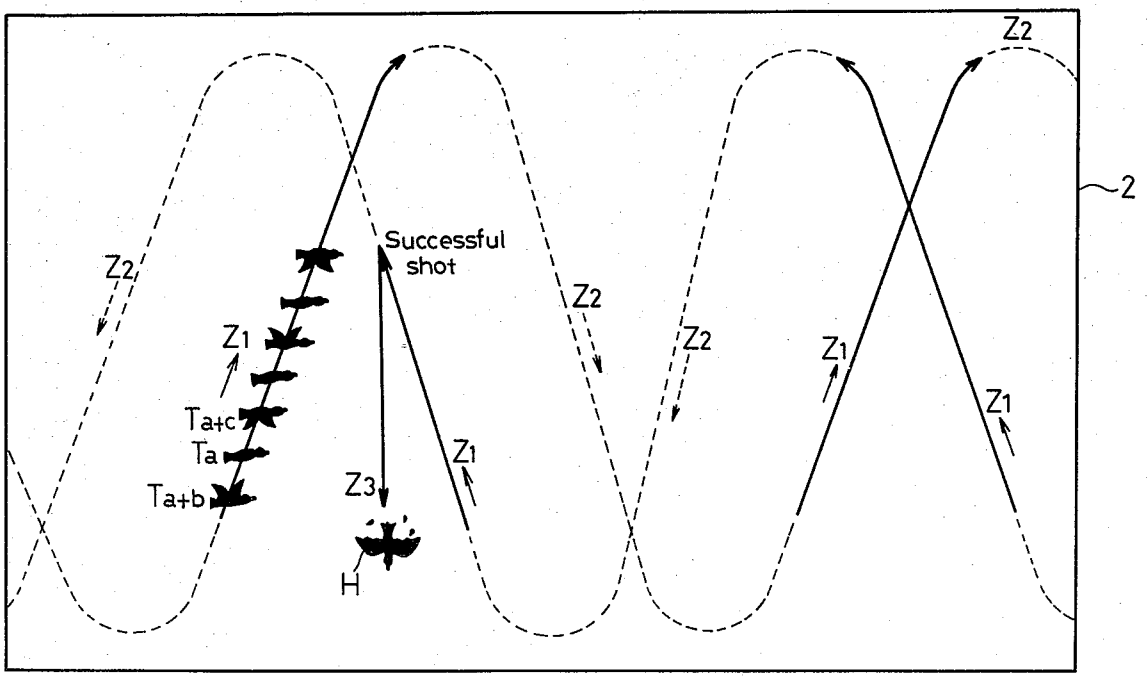
FIG. 13 is a schematic view showing the flight path of the target mark, wherein the unbroken line $Z_1$ signifies a normal flight, the broken line $Z_2$ indicates that the light source is off and the mark does not exist, and the unbroken line $Z_3$ represents the fall of the mark.

Referring to the configuration of the target mark T shown in FIG. 11, it comprises a basic area (a), a first extension area (b) and a second extension area (c). On the other hand, the first portion 40A, the second portion 40B and the third portion 40C of the shutter hole 40 allow the passing of light corresponding to the area (a)+area (b), the area (a), and the area (a)+area (c), respectively. Therefore, by the moving of the second movable diaphragm member 37 in the $\alpha$ direction, as shown in FIGS. 12A, 12B and 12C the light which passes through the shutter hole 40 changes in the order of (a)+(b)→(a)→(a)+(c), with the result of the change shown in FIG. 13, namely, Ta+b→Ta→Ta+c→Ta→Ta+b. However, due to afterglow effect Ta is almost invisible and it appears as if Ta+b and Ta+c are alternated and hence the target mark T on the screen appears to have flapping wings. In the embodiment of the present invention illustrated in the drawings, the rate of wing beat of the bird is 300 per minute, with a total of 10 beats per flight over a vertical distance of 50 centimeters across the screen.

With regard to the configuration of the target mark T and the hit mark H on the screen, since the light Q is partly shaded by the photoelectric element 11, its central part is supposedly dark, but the ratio of the shading area created by the photoelectric element 11 to the light flux sectional area of the light Q at the part where the light passes through the photoelectric element 11 is $(D_2)^2:(D_1)^2$ and $D_2 << D_1$ as shown in FIG. 3. Consequently shading of the light Q by the photoelectric element 11 is very slight. Furthermore, in the light path between the photoelectric element 11 and the screen 2, light penetrates into a true center from the circumference of the shaded central part and substantially no dark portion is present in the target mark T and the hit mark H. Thus, the arrangement of the photoelectric element 11 on the optical axis gives no trouble whatever. Also, since the photoelectric element 11 is located nearer to the lens side 7 than is the diaphragm unit 6, the action of the diaphragm unit 6 will not affect the light receiving sensitivity of the photoelectric element 11. Only the central portion of the hit light H acts on the photoelectric element 11 and the greater part of it has no effect, but since the light receiving sensitivity of the photoelectric element 11 can be regulated by the selection of the working voltage of the electric element of the motor control device 10, it is possible to adjust the quantity of light (quantity of light at the central part of the hit light) to which the photoelectric element reacts and to control the range of receiving the hit light on the screen. Thus, receiving of only a portion of the hit light will suffice.

For the reasons as stated above, even if the optical axis of the target light Q and that of the hit light P are united (exactly or substantially) into one, the photoelectric element 11 reacts effectively and accurately to the hit and generates an output signal. Also, since the optical axis of the incident light Q and that of the hit light P are united (exactly or substantially) into one, the center point of the target on the screen and the center point of the effective hit range on the screen from the light-emission gun are kept constant, irrespective of the movement of the target due to the change of angles or inclination of the mirror 8, whereby the quantity of the hit light reflected toward the photoelectric element is kept constant and the hit response upon the successful hit is also kept constant. Besides, the present invention has such advantage that since the lens system 7 is of unitary type and has fewer parts, with the light source 5, the photoelectric element 11, the lens 7 and the mirror 8 arranged on a straight line, formation of the target and the hit indicating unit 3 can be made compact.

What is claimed is:

1. A light-emission gun amusement device which projects a light image onto a screen and receives a reflected light image from said screen, said device comprising;

a light-emission gun;

a machine housing separate from said light-emission gun and said screen;

a light source within said housing;

a photoelectric element within said housing above said light source;

mirror means within said housing above said light source and said photoelectric element for reflecting said light from said light source to said screen and for reflecting light from said screen to said photoelectric element;

lens means within said housing between said mirror means and said photoelectric element for substantially coaxially aligning the light rays from said light source to said mirror and for substantially aligning said light rays from said screen reflected by said mirror means toward said photoelectric element;

an electrically operated motor within said housing;

a main shaft operatively connected to said motor;

mirror drive means connected to said main shaft and abutting said mirror means for moving said mirror means both vertically and horizontally;

an electrical power source connected to said light source and said motor;

a power source control means actuated by said photoelectric element for reversing the electrical connection between said power source and said motor when said light from said screen is reflected to said photoelectric element, thereby reversing the normal rotational direction of said motor;

target producing means within said housing between said light source and said photoelectric element and operatively connected to said main shaft for producing target and hit images of said light source on said screen, said target producing means comprised of:

a first diaphragm member means pivotally mounted between said light source and said photoelectric element and operatively connected to said main shaft for selectively producing target and hit images, said first diaphragm member means having a target aperture and a hit mark aperture to selectively produce said target image and said hit image when light from said light source shines through said apertures, said target image being produced when said main shaft is rotating normally and said hit image being produced when the direction of the said main shaft's normal rotational direction is reversed.

2. A devices as claimed in claim 1, wherein said target producing means is further comprised of:

a second movable diaphragm member means between said first diaphragm member and said photoelectric element and operatively connected to said main shaft for selectively simulating movement of said target image and maintaining a fixed hit image, said second diaphragm member means having first and second shutter openings therethrough, said first shutter opening being reciprocally movable back and forth above said target aperture when said main shaft is turning in the normal direction, thus making the light shining through said target aperture simulate motion of the target image, and said second shutter opening remaining continuously stationary above said hit mark aperture when said main shaft's normal rotational direction is reversed, thereby continuously allowing hit image to shine therethrough.

3. A device as claimed in claim 1, wherein said lens means is comprised of a single lens positioned between said photoelectric element and said mirror means, whereby said light emitted from said light source through said target projecting means passes through said single lens toward said mirror means before it is reflected by said mirror means towards its screen and whereby said light reflected from said screen by said mirror means passes through said single lens before contacting said photoelectric element.

4. A device as claimed in claim 1, wherein said photoelectric element has a surface area smaller than the cross-sectional area of the light reflected from said screen by said mirror means at the point where said reflected light contacts said photoelectric element.

5. A light-emission gun amusement machine for projecting a light image onto a screen and for receiving a reflected image from said screen, said device comprising:

a light-emission gun;

a machine housing separate from said light-emission gun and said screen;

a light source within said housing;

a photoelectric element within said housing above said light source;

lens means in front of said light source and said photoelectric element within said housing and said screen for coaxially aligning the light rays from said light source to said screen and said light rays from said screen towards said photoelectric element;

an electrically operative motor within said housing;

a main shaft operatively connected to said motor;

an electric power source connected to said light source and said motor;

a power source control means actuated by said photoelectric element for reversing the electrical connection between said power source and said motor when light is reflected from said screen onto said photoelectric element and reversing the normal rotationaly direction of said motor;

target producing means within said housing between said light source and said photoelectric element operatively connected to said main shaft for producing target and hit images of said light source on said screen, said target producing means comprised of:

a first diaphragm member pivotally mounted between said light source and said photoelectric element and operatively connected to said main shaft for selectively producing target and hit images, said first diaphragm member means having a target aperture and a hit mark aperture to selectively produce said target image and said hit image when light from said light source shines through said apertures, said target image being produced when said main shaft is rotating normally and said hit image being produced when the direction of said main shaft's normal rotational direction is reversed.

6. A devices as claimed in claim 5, wherein said target producing means is further comprised of:

a second movable diaphragm member means between said first said diaphragm member means and said photoelectric element and operatively connected to said main shaft's for selectively simulating movement of said target image and maintaining a fixed hit image, said second diaphragm member means having first and second shutter openings therethrough, said first shutter opening being reciprocally movable back and forth above said target aperture when said main shaft is turning in the normal direction to make the light shining through said target aperture simulate motion of the target image, and said second shutter opening remaining continuously stationary above said hit mark aperture when said main shaft's normal rotational direction is reversed, thereby continuously allowing said hit image to shine therethrough.

7. A device as claimed in claim 5, wherein said lens means is comprised of a single lens positioned between said light source and said photoelectric element within said housing and said screen.

8. A device as claimed in claim 5, wherein the surface area of said photoelectric element is smaller than the sectional area of said light reflected from said screen through said lens means toward said photoelectric element.

9. A light-emission gun amusement device which projects a light image onto a screen and receives a reflected light from said screen, said device comprising:

a light-emission gun;

a machine housing separate from said light-emission gun and said screen;

a light source within said housing;

an electrically operated motor within said housing;

a main shaft operatively connected to said motor;

an electrical power source connected to said light source and said motor;

a power source control means between said power source and said motor for reversing the electrical connection between said power source and said motor and for reversing the normal rotational direction of said motor; and target producing means within said housing between said light source and said screen operatively connected to said main shaft for producing target and hit images of said light source on said screen, said target producing means comprised of:

a first diaphragm member means pivotally mounted between said light source and said screen and operatively connected to said main shaft for selectively producing target and hit images, said first diaphragm member means having a target aperture and a hit mark aperture to selectively produce said target image and said hit image when light from said light source shines through said apertures, said target image being produced when said main shaft is rotating normally and said hit image being produced when the direction of said main shaft's normal rotational direction is reversed.

10. A device as claimed in claim 9, wherein said target producing means is further comprised of:

a second movable diaphragm member means between said first diaphragm member means and said screen, operatively connected to said main shaft for selectively simulating movement of said target image and maintaining a fixed hit image, said second diaphragm member means having first and second shutter openings therethrough, said first shutter opening being reciprocally movable back and forth above said target aperture when said main shaft is turning in the normal direction to make the light shining from said target aperture simulate motion of the target image, and said second shutter opening remaining continuously stationary above said hit mark aperture when said main shaft's normal rotational direction is reversed thereby continuously allowing said hit image to shine therethrough.

11. A light-emission gun amusement device for projecting a light image onto a screen and receiving a reflected light image from said screen, said device comprising:

a light-emission gun;

a machine housing separate from said light-emission gun and said screen;

a light source within said housing;

a photoelectric element within said housing above said light source;

lens means within said housing between said photoelectric element and said screen for substantially coaxially aligning the light rays shining from said light source to said screen and said light rays from said screen reflected toward said photoelectric element;

an electrically operated motor within said housing;

an electrical power source connected to said light source and said motor;

a power source control means between said power source and said motor actuated by said photoelectric element for reversing the electrical connection between said power source and said motor and for reversing the normal rotational direction of said motor; and target producing means within said housing between said light source and said photoelectric element operatively connected to said motor for producing target and hit images of said light source on said screen.

* * * * *